US010451067B2

(12) United States Patent
Zhou et al.

(10) Patent No.: US 10,451,067 B2
(45) Date of Patent: Oct. 22, 2019

(54) ROTARY COMPRESSOR AND COMPRESSION UNIT THEREOF, AND AIR CONDITIONER

(71) Applicant: GUANGDONG MEIZHI COMPRESSOR CO., LTD., Foshan, Guangdong (CN)

(72) Inventors: Xingbiao Zhou, Guangdong (CN); Yongjun Fu, Guangdong (CN); Liyu Zheng, Guangdong (CN); Cheng Zhang, Guangdong (CN); Hong Guo, Guangdong (CN)

(73) Assignee: GUANGDONG MEIZHI COMPRESSOR CO., LTD., Foshan, Guangdong (CN)

( * ) Notice: Subject to any disclaimer, the term of this patent is extended or adjusted under 35 U.S.C. 154(b) by 299 days.

(21) Appl. No.: 15/101,911

(22) PCT Filed: Dec. 5, 2013

(86) PCT No.: PCT/CN2013/088688

§ 371 (c)(1),
(2) Date: Jun. 5, 2016

(87) PCT Pub. No.: WO2015/081543

PCT Pub. Date: Jun. 11, 2015

(65) Prior Publication Data

US 2016/0305429 A1 Oct. 20, 2016

(51) Int. Cl.
*F04C 18/356* (2006.01)
*F04C 23/00* (2006.01)
(Continued)

(52) U.S. Cl.
CPC ..... *F04C 23/003* (2013.01); *F04C 18/3564* (2013.01); *F04C 23/001* (2013.01);
(Continued)

(58) Field of Classification Search
CPC .. F04C 23/003; F04C 18/3564; F04C 23/001; F04C 29/0057; F04C 29/12;
(Continued)

(56) References Cited

U.S. PATENT DOCUMENTS 4,544,337 A * 10/1985 Maruyama ..... F04C 28/18 418/15
5,733,112 A * 3/1998 Kang ..... F04C 18/3564 418/174
(Continued)

FOREIGN PATENT DOCUMENTS

CN 1548753 A 11/2004
CN 202391734 U 8/2012
(Continued)

OTHER PUBLICATIONS

China Patent Office, Office action dated Jul. 24, 2015 for CN application 201310655852.X.
(Continued)

*Primary Examiner* — Deming Wan
(74) *Attorney, Agent, or Firm* — Houtteman Law LLC

(57) ABSTRACT

A compression device includes an air cylinder (31); an upper bearing (4) and a lower bearing (5); a piston (71) which defines a working space; a first slide vane (81) and a second slide vane (82) which separate the working space into a first and a second working chamber; a first air suction port (101) and a second air suction port (102) both of which are in communication with the working space; and a first air discharge port (91) and a second air discharge port (92) both of which are in communication with the working space. The first and the second air suction port satisfy the following condition: $0.25 \leq (V_1/S_1)*(S_2/V_2) \leq 4$, where VI and V2 are respectively the maximum volume of the first and the second
(Continued)

90° working chamber, and S1 and S2 are respectively the opening area of the first and the second air suction port.

20 Claims, 9 Drawing Sheets

(51) Int. Cl.

| | |
|---|---|
| ***F04C 29/12*** | (2006.01) |
| ***F04C 18/344*** | (2006.01) |
| ***F04C 29/00*** | (2006.01) |
| ***F25B 13/00*** | (2006.01) |
| ***F25B 31/02*** | (2006.01) |
| *F04C 18/32* | (2006.01) |

(52) U.S. Cl.
CPC ..... *F04C 29/0057* (2013.01); *F04C 29/12* (2013.01); *F25B 13/00* (2013.01); *F25B 31/026* (2013.01); *F04C 18/322* (2013.01); *F04C 23/008* (2013.01); *F04C 2250/101* (2013.01); *F25B 2500/12* (2013.01)

(58) Field of Classification Search
CPC .. F04C 18/3446; F04C 18/3556; F25B 13/00; F25B 13/026
USPC ... 418/150, 15, 68, 173, 177, 260, 241, 139, 418/11
See application file for complete search history.

(56) References Cited

U.S. PATENT DOCUMENTS

| | | | | |
|---|---|---|---|---|
| 6,213,732 | B1 | 4/2001 | Fujio | |
| 7,632,082 | B2 * | 12/2009 | Ogasawara | F04C 23/008 184/6.18 |
| 8,323,009 | B2 * | 12/2012 | Shimizu | F04C 15/0042 418/11 |
| 2009/0035166 | A1 | 2/2009 | Newland | |
| 2010/0269536 | A1 * | 10/2010 | Wada | F01C 13/04 62/402 |

FOREIGN PATENT DOCUMENTS

| | | | |
|---|---|---|---|
| CN | 203614402 | U | 5/2014 |
| JP | H10213087 | A | 8/1998 |
| JP | 2007239588 | A | 9/2007 |
| JP | 2009197795 | A | 9/2009 |
| JP | 2010150949 | A | 7/2010 |
| JP | 2010156487 | A | 7/2010 |
| JP | 2011032958 | A | 2/2011 |

OTHER PUBLICATIONS

European Patent Office, Office action dated Jul. 7, 2017 for EP application 13898730, which is an European counterpart patent application of the present US patent application.
Japan Patent Office, Office action dated Aug. 16, 2017 for JP application 2015560526, which is a Japan counterpart patent application of the present US patent application.
Japan Patent Office, Office action dated Aug. 14, 2018 for Japan patent application No. 2015560526.

* cited by examiner

A-A

0°

90°

C-C

D-D

E-E

ROTARY COMPRESSOR AND COMPRESSION UNIT THEREOF, AND AIR CONDITIONER

CROSS-REFERENCE TO RELATED APPLICATION

This application is a U.S. national phase application of International Application No. PCT/CN2013/088688, filed on Dec. 5, 2013, the entire content of which is incorporated herein by reference.

FIELD

The present disclosure relates to a field of refrigeration apparatuses, and more particularly relates to a compression device of a rotary compressor, a rotary compressor including the same and an air conditioner including the rotary compressor.

BACKGROUND

A single-cylinder rotary compressor shown in FIG. 1 in the related art has advantages of simple machining and good performance and is applied widely to a room air conditioner. However, since vibration amplitude of the compressor is determined basically by a size of a torque fluctuation when the compressor is working, the larger vibration of the compressor not only seriously affects reliabilities of the compressor and the air conditioner, but also causes serious noise problems.

Due to adopting single-cylinder eccentric compression technologies, the torque of compressed gas changes greatly during a usage of the single-cylinder rotary compressor, as "Torque A" shown in FIG. 4. Furthermore, the vibration of the compressor is increased with an increase of a compressor displacement, and the noise of the air conditioner is increased, too, thus affecting the usage.

Compared with the single-cylinder compressor in the art, a double-cylinder rotary compressor with the same displacement has an upper air cylinder and a lower air cylinder, two eccentric portions of a crankshaft thereof are configured to form 180°, and the torque of the compressed gas changes much smaller (which is shown as "Torque B" in FIG. 4), thus reaching a good vibration performance. However, the double-cylinder rotary compressor, compared with the single-cylinder rotary compressor, has disadvantages of a large amount of components and parts and dramatically increasing manufacturing costs. In addition, due to adding a set of compression assembly, friction pairs are increased, thus making friction losses to increase.

SUMMARY

The present disclosure aims to solve at least one of the problems in the related art. For this, one objective of the present disclosure is to provide a compression device of a rotary compressor that can reduce the noise.

Another objective of the present disclosure is to provide a rotary compressor including the compression device.

Yet another objective of the present disclosure is to provide an air conditioner including the rotary compressor.

According to embodiments of a first aspect of the present disclosure, a compression device of a rotary compressor includes: an air cylinder being hollow and having an open top portion and an open bottom portion, in which a first sliding vane slot and a second sliding vane slot are formed in the air cylinder; an upper bearing and a lower bearing respectively provided on the top portion and the bottom portion of the air cylinder, so as to define a chamber together with the air cylinder; a piston actuated by an eccentric crankshaft, provided within the chamber eccentrically and being rollable along an inner wall of the chamber, in which a working space is defined between the piston and the inner wall of the chamber; a first sliding vane and a second sliding vane, in which the first sliding vane and the second sliding vane are provided respectively within the first sliding vane slot and the second sliding vane slot movably, first ends of the first sliding vane and the second sliding vane both extend into an interior of the chamber and abut against the piston, and the first sliding vane and the second sliding vane separate the working space into a first working chamber and a second working chamber; a first air suction port and a second air suction port, in which the first air suction port and the second air suction port are both in communication with the working space, and the first air suction port is provided to be adjacent to the first sliding vane slot and the second air suction port is provided to be adjacent to the second sliding vane slot; and a first air discharge port and a second air discharge port, in which the first air discharge port and the second air discharge port are both in communication with the working space, and the first air discharge port is provided to be adjacent to the second sliding vane slot and the second air discharge port is provided to be adjacent to the first sliding vane slot. The first air suction port and the second air suction port are configured to satisfy a following condition:

$$0.25 \le \frac{V_1}{S_1} * \frac{S_2}{V_2} \le 4,$$

where $V_1$ represents a maximum volume of the first working chamber, $V_2$ represents a maximum volume of the second working chamber, $S_1$ represents an opening area of the first air suction port, and $S_2$ represents an opening area of the second air suction port.

The compression device according to embodiments of the present disclosure, by designing relationships between each of the first air suction port and the second air suction port and each of volumes of the first working chamber and the second working chamber, improves the torque fluctuation of the rotary compressor, reduces the vibration of the rotary compressor, the noise and the costs increase effectively.

According to an embodiment of the present disclosure, in a rotation direction of the crankshaft, an angle θ between the first sliding vane and the second sliding vane satisfies $30° \le \theta \le 330°$.

Alternatively, the angle $\theta = 180°$.

According to an embodiment of the present disclosure, the first air discharge port is located at an upstream of the second sliding vane slot in a rotation direction of the crankshaft, and the second air discharge port is located at an upstream of the first slide slot in the rotation direction of the crankshaft.

According to an embodiment of the present disclosure, a first suction valve is provided within the first air suction port.

According to an embodiment of the present disclosure, a second suction valve is provided within the second air suction port. Therefore, the increase of the displacement of the compressor is realized effectively and the performance of the compressor is improved.

Alternatively, the first sliding vane and the piston are formed integrally, thus reducing effectively and even eliminating leakage losses and friction losses between the first sliding vane and the piston.

According to an embodiment of the present disclosure, the first air suction port and the second air suction port are provided respectively in one of the air cylinder, the upper bearing and the lower bearing.

Alternatively, the first air discharge port and the second air discharge port are provided respectively in one of the air cylinder, the upper bearing and the lower bearing.

The compression device according to embodiments of the present disclosure is applied to a single-cylinder compressor, in which one sliding vane is added only, thus omitting exponential increase of the air cylinder and the piston in the double-cylinder rotary compressor in the related art, and the cost of which is almost the same with that of the single-cylinder rotary compressor in the relater art, however, an effect similar with that of the torque curve of the double-cylinder rotary compressor is got, thus improving the torque fluctuation of the compressor. Further, with the compression device according to embodiments of the present disclosure, the suction valves are added in each of the air suction port, and the actual displacement of the compressor can be improved greatly, thus improving the performance of the compressor.

According to an embodiment of the present disclosure, the compression device further includes: a secondary air cylinder provided below the air cylinder coaxially, in which a third sliding vane slot is formed in the secondary air cylinder; a middle partition plate provided between the air cylinder and the secondary air cylinder and separating the chamber into an upper chamber and a lower chamber, in which the piston is provided within the upper chamber and defines the working space together with an inner wall of the upper chamber; a secondary piston actuated by the eccentric crankshaft, provided within the lower chamber eccentrically and being rollable along an inner wall of the lower chamber, in which a secondary working space is defined between the secondary piston and the inner wall of the lower chamber; a third sliding vane, in which the third sliding vane is provided within the third sliding vane slot movably and a first end of the third sliding vane extends into an interior of the lower chamber and abuts against the secondary piston; a third air suction port, in which the third air suction port is provided to be adjacent to the third sliding vane slot and is in communication with the secondary working space; a third air discharge port, in which the third air discharge port is provided to be adjacent to the third sliding vane slot and is in communication with the secondary working space.

According to an embodiment of the present disclosure, at least one of the first air suction port, the second air suction port and the third air suction port is provided in the middle partition plate, and at least one of the first air discharge port, the second air discharge port and the third air discharge port is provided in the middle partition plate.

According to an embodiment of the present disclosure, the third air suction port is formed in one of the secondary air cylinder, the lower bearing and the middle partition plate, and the third air discharge port is formed in one of the secondary air cylinder, the lower bearing and the middle partition plate.

Alternatively, the third air suction port is provided in the middle partition plate and the third air discharge port is provided in the secondary air cylinder.

According to an embodiment of the present disclosure, a third suction valve is provided within the third air suction port.

According to an embodiment of the present disclosure, the third sliding vane and the secondary piston are formed integrally.

According to an embodiment of the present disclosure, a fourth sliding vane slot is formed in the secondary air cylinder, and the compression device further includes: a fourth sliding vane, in which the fourth sliding vane is provided within the fourth sliding vane slot movably and a first end of the fourth sliding vane extends into the interior of the lower chamber and abuts against the secondary piston; a fourth air suction port, in which the fourth air suction port is provided to be adjacent to the fourth sliding vane slot and is in communication with the secondary working space; and a fourth air discharge port, in which the fourth air discharge port is provided to be adjacent to the fourth sliding vane slot and is in communication with the secondary working space.

According to an embodiment of the present disclosure, at least one of the first air suction port, the second air suction port, the third air suction port and the fourth air suction port is provided in the middle partition plate, and at least one of the first air discharge port, the second air discharge port, the third air discharge port and the fourth air discharge port is provided in the middle partition plate.

Alternatively, the first air suction port, the second air suction port, the third air suction port and the fourth air suction port are all provided in the middle partition plate, and the third air discharge port and the fourth air discharge port are provided in the secondary air cylinder.

According to an embodiment of the present disclosure, the third air suction port and the fourth air suction port are provided respectively in one of the secondary air cylinder, the lower bearing and the middle partition plate, and the third air discharge port and the fourth air discharge port are provided in one of the secondary air cylinder, the lower bearing and the middle partition plate.

Alternatively, a fourth suction valve is provided within the fourth air suction port.

According to an embodiment of the present disclosure, the eccentric crankshaft includes a first eccentric portion fitted over with the piston and a second eccentric portion fitted over with the secondary piston, and an angle $\beta$ between a protruding direction of the first eccentric portion and a protruding direction of the second eccentric portion in a rotation direction of the crankshaft satisfies $90° \leq \beta \leq 270°$.

Alternatively, the angle $\beta=180°$.

The compression device according to embodiments of the present disclosure combines the advantages of the foregoing embodiments of the single-cylinder rotary compressor and the existing double-cylinder rotary compressor, thus further improving the torque fluctuation of the compressor greatly.

According to embodiments of a second aspect of the present disclosure, a rotary compressor includes the compression device of the rotary compressor according to embodiments of the first aspect of the present disclosure.

According to embodiments of a third aspect of the present disclosure, an air conditioner includes the rotary compressor according to embodiments of the second aspect of the present disclosure.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which:

FIGS. 3*a* to 3*d* are schematic views showing working processes of a rotary compressor according to an embodiment of the present disclosure respectively, in which FIG. 3*a* is a schematic view when a piston rotates at a starting position, FIG. 3*b* is a schematic view when a piston rotates at a 90° position, FIG. 3*c* is a schematic view when a piston rotates at a 180° position and FIG. 3*d* is a schematic view when a piston rotates at a 270° position;

REFERENCE SIGNS

Figure 1A:
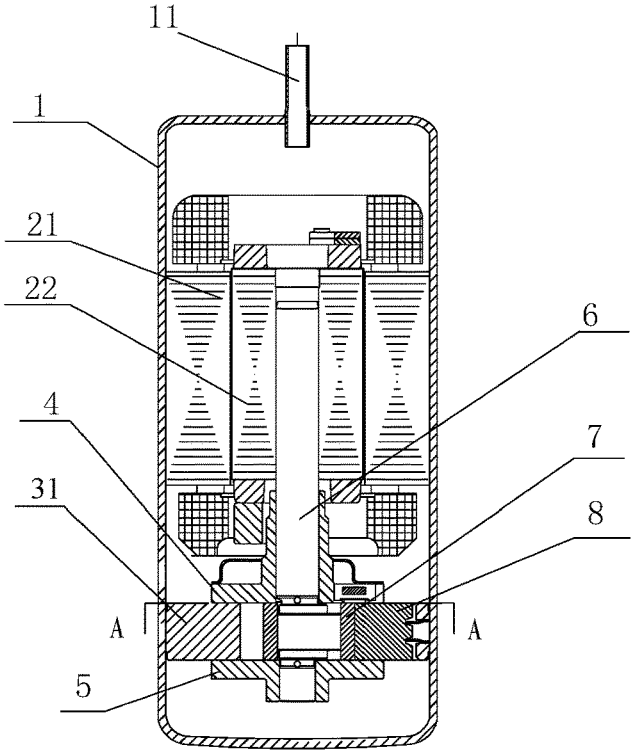
FIG. 1*a* and FIG. 1*b* are schematic views showing a pump structure and a compression process of a single-cylinder rotary compressor in the related art respectively.
Figure 1B:
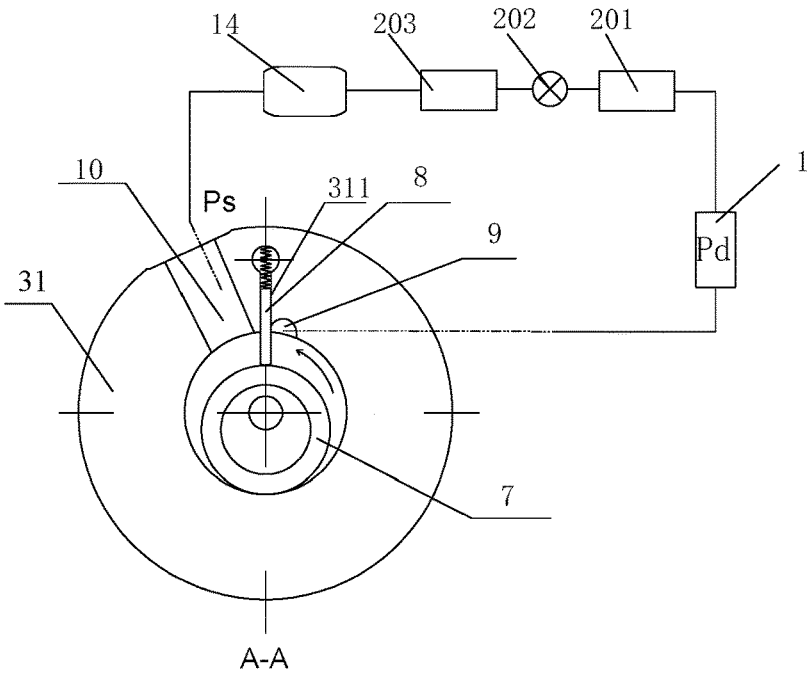

100: rotary compressor;

1: housing; 11: air discharge pipe; 21: stator; 22: rotor;

31: air cylinder; 311: first sliding vane slot; 312: second sliding vane slot;

32: secondary air cylinder; 321: third sliding vane slot; 322: fourth sliding vane slot;

4: upper bearing; 5: lower bearing;

40: chamber; 401: upper chamber; 402: lower chamber;

6: crankshaft; 61: first eccentric portion; 62: second eccentric portion;

71: piston; 72: secondary piston;

81: first sliding vane; 82: second sliding vane; 83: third sliding vane; 84: fourth sliding vane

91: first air discharge port; 92: second air discharge port; 93: third air discharge port; 94: fourth air discharge port;

101: first air suction port; 102: second air suction port; 103: third air suction port; 104: fourth air suction port;

12: middle partition plate;

131: first air suction valve; 132: second air suction valve; 133: third air suction valve; 134: fourth air suction valve;

14: reservoir;

200: air conditioner;

201: outdoor heat exchanger; 202: throttling device;

203: indoor heat exchanger; 204: four-way valve;

M1: first working chamber; M2: second working chamber;

N1: air suction chamber; N2: compression chamber; N3: intermediate chamber

DETAILED DESCRIPTION

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

In the description, unless specified or limited otherwise, it is to be understood that phraseology and terminology used herein with reference to device or element orientation (for example, terms like "central," "upper," "lower," "front," "rear," "top," "button," "inner," "outer," etc.) should be construed to refer to the orientation as then described or as shown in the drawings under discussion for simplifying the description of the present disclosure, but do not alone indicate or imply that the device or element referred to must have a particular orientation. They cannot be seen as limits to the present disclosure. In addition, terms such as "first" and "second" are used herein for purposes of description and are not intended to indicate or imply relative importance or significance. Thus, the feature defined with "first" and "second" may comprise one or more this feature. In the description of the present disclosure, "a plurality of" means two or more than two, unless specified otherwise.

In the description of the present disclosure, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

In the following, a compression device of a rotary compressor according to embodiments of the present disclosure will be described in detail with reference to FIGS. 2*a* and 2*b*, in which the rotary compressor further includes a housing 1 and an actuator 2. An accommodating space is defined within the housing 1, and the actuator 2 is provided in an upper portion of the accommodating space. Alternatively, the actuator 2 is a motor consisting of a stator 21 and a rotor 22.

The compression device of a rotary compressor according to embodiments of the present disclosure, includes an air cylinder 31, an upper bearing 4 and a lower bearing 5, a piston 71, a first sliding vane 81 and a second sliding vane 82, a first air suction port 101 and a second air suction port 102, and a first air discharge port 91 and a second air discharge port 92.

Figure 2A:
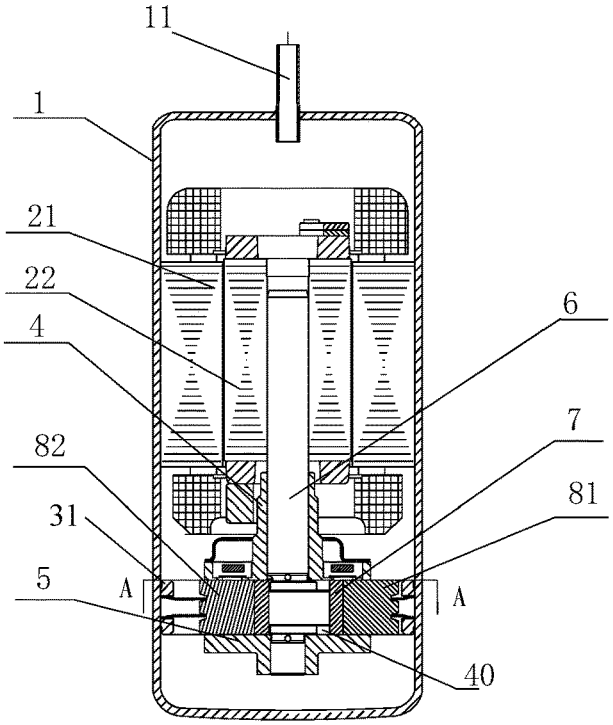
FIG. 2*a* and FIG. 2*b* are schematic views showing a pump structure and a compression process of a rotary compressor according to an embodiment of the present disclosure respectively.
Figure 2B:
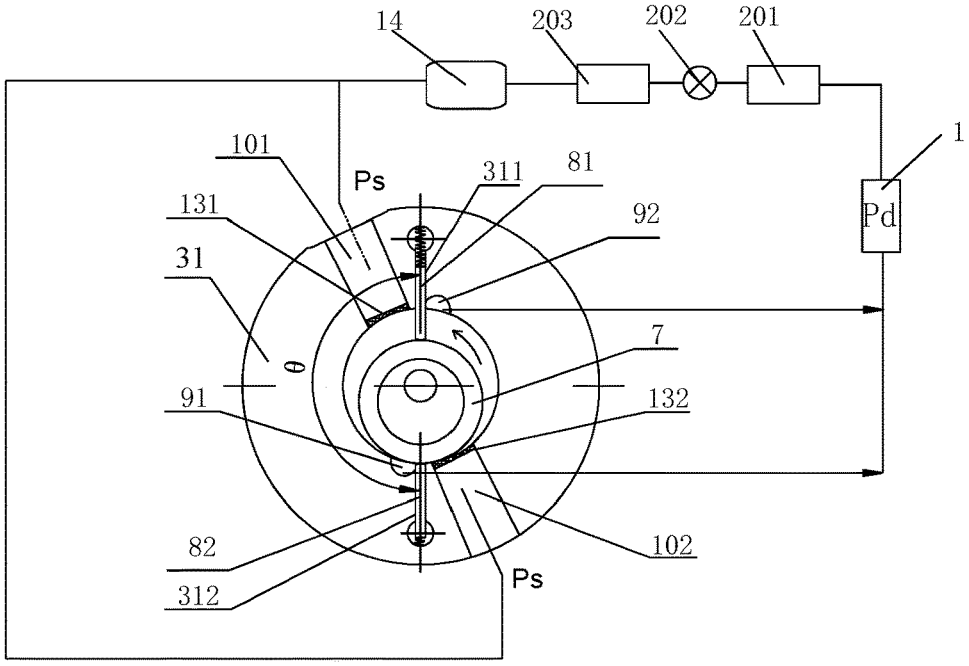

As shown in FIGS. 2*a* and 2*b*, the air cylinder 31 is hollow and a top portion and a bottom portion thereof are open, the air cylinder 31 is provided in a lower portion of the accommodating space and located below the actuator 2, and the air cylinder 31 may be formed as a cylindrical shape having the open top portion and the open bottom portion. A first sliding vane slot 31 and a second sliding vane slot 32 are formed in the air cylinder 31. Specifically, the first sliding vane slot 31 and the second sliding vane slot 32 extend in a radial direction on a side wall of the air cylinder 31 and are provided and spaced apart from each other. The upper bearing 4 and the lower bearing 5 are respectively provided on the top portion and the bottom portion of the air cylinder 31, so as to define a chamber 40 together with the air cylinder 31. The piston 71 is actuated by an eccentric crankshaft 6, and is provided within the chamber 40 eccentrically and can roll along an inner wall of the chamber 40, in which a working space is defined between the piston 71 and the inner wall of the chamber 40.

The crankshaft 6 is actuated by the actuator to rotate, is supported by the upper bearing 4 and the lower bearing 5 and fitted over with the piston 71 eccentrically. Referring to FIGS. 2*a* and 2*b*, the crankshaft 6 extends in an up-down direction and passes through the upper bearing 4, the air cylinder 31 and the lower bearing 5 in sequence. An eccentric portion 61 is provided with the crankshaft 6. Alternatively, the eccentric portion 61 and the crankshaft 6 are formed integrally, and the piston 71 is fitted over and outside the eccentric portion 61. When the rotary compressor 100 is working, the actuator such as the motor actuates the eccentric portion 61 of the crankshaft 6 to perform an eccentric rotation, thus driving the piston 71 to move along an inner wall of the air cylinder 31.

The first sliding vane 81 and the second sliding vane 82 are provided respectively within the first sliding vane slot 311 and the second sliding vane slot 312 movably. In other words, the first sliding vane 81 is provided within the first sliding vane slot 311 movably and the second sliding vane 82 is provided within the second sliding vane slot 312 movably. In some preferable embodiments of the present disclosure, an angle θ between the first sliding vane 81 and the second sliding vane 82 satisfies 30°≤θ≤330° in a rotation direction of the crankshaft 6. Preferably, the angle θ=180°.

First ends of the first sliding vane 81 and the second sliding vane 82 both extend into an interior of the chamber 40 and abut against the piston 71, and the first sliding vane 81 and the second sliding vane 82 separate the working space into a first working chamber M1 and a second working chamber M2. Specifically, as shown in FIGS. 2*a*, 2*b*and 3, the working space between the air cylinder 31 and the piston 71 is separated into two working chambers 40 at left and right, being the first working chamber M1 and the second working chamber M2 respectively. A point of tangency of the piston 71 and the air cylinder 31 separates the working chamber thereof into two parts: an air suction chamber N1 and a compression chamber N2, and another complete working chamber is named as an intermediate chamber N3.

The first air suction port 101 and the second air suction port 102 are both in communication with the working space, the first air suction port 101 is provided to be adjacent to the first sliding vane slot 311, and the second air suction port 102 is provided to be adjacent to the second sliding vane slot 312. The first air discharge port 91 and the second air discharge port 92 are both in communication with the working space, the first air discharge port 91 is provided to be adjacent to the second sliding vane slot 312, and the second air discharge port 92 is provided to be adjacent to the first sliding vane slot 311. In which, the first air suction port 101 can lead working fluid that should be compressed by the first working chamber M1 into the first working chamber M1 and the second air suction port 102 can lead working fluid that should be compressed by the second working chamber M2 into the second working chamber M2. The first air discharge port 91 can lead working fluid compressed by the first working chamber M1 into an exterior of the first working chamber M1 and the second air discharge port 92 can lead working fluid compressed by the second working chamber M2 into an exterior of the second working chamber M2.

The first air suction port 101 and the second air suction port 102 are configured to satisfy a following condition:

$$0.25 \le \frac{V_1}{S_1} * \frac{S_2}{V_2} \le 4$$

wherein $V_1$ represents a maximum volume of the first working chamber M1, $V_2$ represents a maximum volume of the second working chamber M2, $S_1$ represents an opening area of the first air suction port 101, and $S_2$ represents an opening area of the second air suction port 102.

In the following, working principle and refrigerant flowing modes will be described with reference to FIGS. 3*a* to 3*b*, when the compression device according to embodiments of the present disclosure is applied to the rotary compressor, which is described by taking θ=180° as an example.

Referring to FIGS. 3*a* to 3*d*, the first sliding vane 81 and the second sliding vane 82 separate working space between the air cylinder 31 and the piston 71 into the first working chamber M1 and the second working chamber M2. The point of tangency of the piston 71 and the inner wall of the air cylinder 31 separates the working chamber thereof into two chambers, which are the air suction chamber N1 and the compression chamber N2 respectively. In addition, another complete working chamber is named as the intermediate chamber N3.

During a range of 0° to 90°, a volume of the compression chamber N2 located within the first working chamber M1 is decreased continuously and a pressure thereof is increased continuously, and a volume of the air suction chamber N1 located within the first working chamber M1 and a volume of the second working chamber M2 (i.e. the intermediate chamber N3) is increased continuously.

During a range of 90° to 180°, the volume of the compression chamber N2 located within the first working chamber M1 is further decreased continuously, the pressure thereof is further increased continuously and when reaching a certain pressure, the working fluid is discharged from the first working chamber M1 via the first air discharge port 91. The volume of the air suction chamber N1 located within the first working chamber M1 is increased continuously but the volume of the second working chamber M2 (i.e. the intermediate chamber N3) is decreased continuously.

During a range of 180° to 270°, the air suction chamber N1 and the compression chamber N2 are located within the second working chamber M2, and the intermediate chamber N3 is the first working chamber M1. The volume of the compression chamber N2 is decreased continuously and the pressure thereof is increased continuously, but the volumes of the air suction chamber N1 and the intermediate chamber N3 are increased continuously.

During a range of 270° to 360°, the volume of the compression chamber N2 located within the second working chamber M2 is further decreased continuously, and the pressure of the compression chamber N2 is further increased continuously and when reaching a certain pressure, the working fluid is discharged from the second working chamber M2 via the second air discharge port 92. The volume of the air suction chamber N1 within the second working chamber M2 is increased continuously, but the volume of the first working chamber M1 (i.e. the intermediate chamber N3) is decreased continuously.

The working fluid discharged from the first air discharge port 91 and the second air discharge port 92 flows upward, and passes through a gap of the actuator, for example a gap between the stator 21 and the rotor 22 of the motor, and is discharged from an discharge pipe 11 of a top portion of the housing 1, and then passes through an outdoor heat exchanger 201 and a throttling device 202 and becomes low-pressure gas in an indoor heat exchanger 203, and then passes through an reservoir 14 and is sucked into the first working chamber M1 and the second working chamber M2 via the first air suction port 101 and the second air suction port 102.

When the crankshaft 6 rotates one circle, the air suction chamber N1 and the compression chamber N2 appear alternately in two working chambers (i.e. the first working chamber M1 and the second working chamber M2), and the three working chambers work simultaneously, and the volumes thereof change periodically, thus completing an entire working circulation of the compressor. As shown in FIGS. 3*a* to 3*d*, there are two times of air discharging at each rotation of the crankshaft 6.

Figure 4:
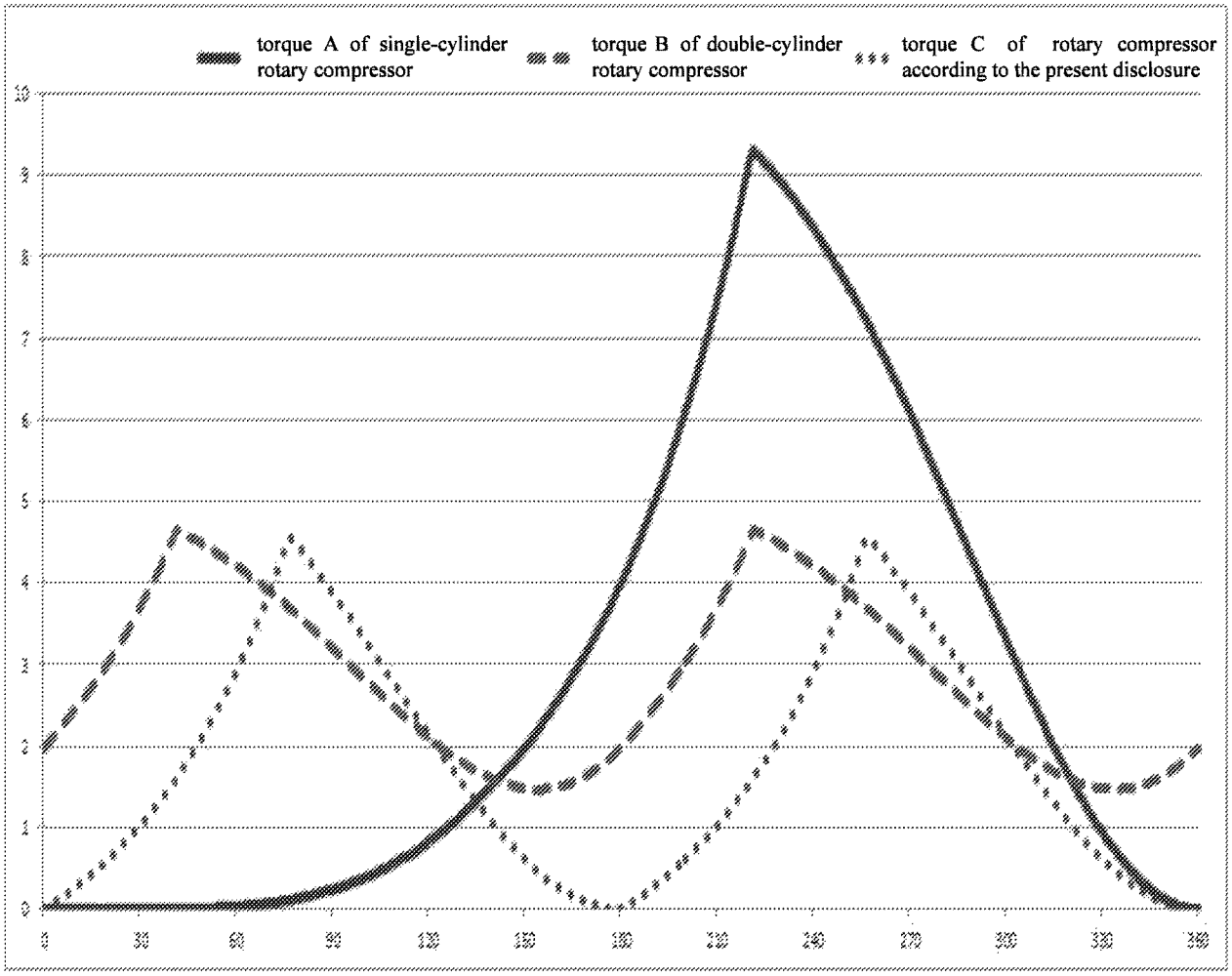
FIG. 4 is a torque comparison chart of a rotary compressor according to an embodiment of the present disclosure respectively with a single-cylinder rotary compressor and a double-cylinder rotary compressor in the related art.

Due to this working principle, compared with the torque fluctuation of the single-cylinder rotary compressor in the related art, that of the rotary compressor according to embodiments of the present disclosure is smaller when working, so that the vibration of the compressor is greatly reduced and close to the level of the double-cylinder rotary compressor in the related art, which is shown in FIG. 4.

Figure 3A:
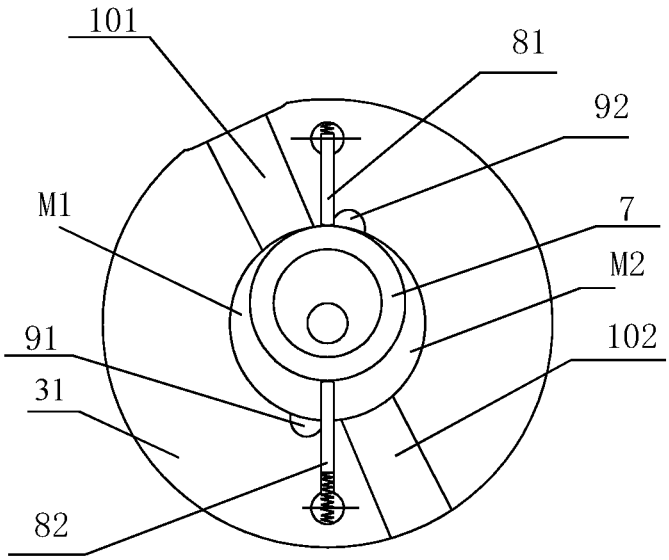
Figure 3B:
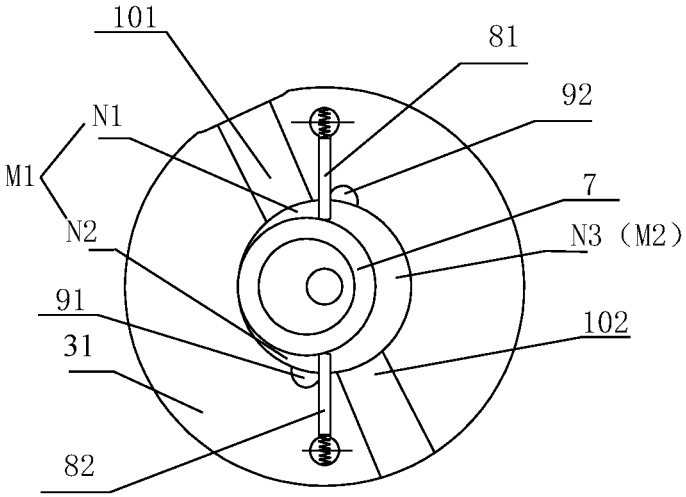

It can be seen from FIGS. 3*a* to 3*b* that, during a range of 0° to 180°, the intermediate chamber N3 is the second working chamber M2, and is in communication with the second air suction port 102, and the volume thereof increases firstly and then decreases. The volume reaches the maximum when at 90°. If there is no air suction valve in the second air suction port 102, when the crankshaft 60 rotates through 90°, the working fluid in the intermediate chamber N3 may flow backwards to the exterior of the second working chamber M2 via the second air suction port 102. Therefore, the maximum volume V2 of the second working chamber M2 occurs when at 90°.

Figure 3C:
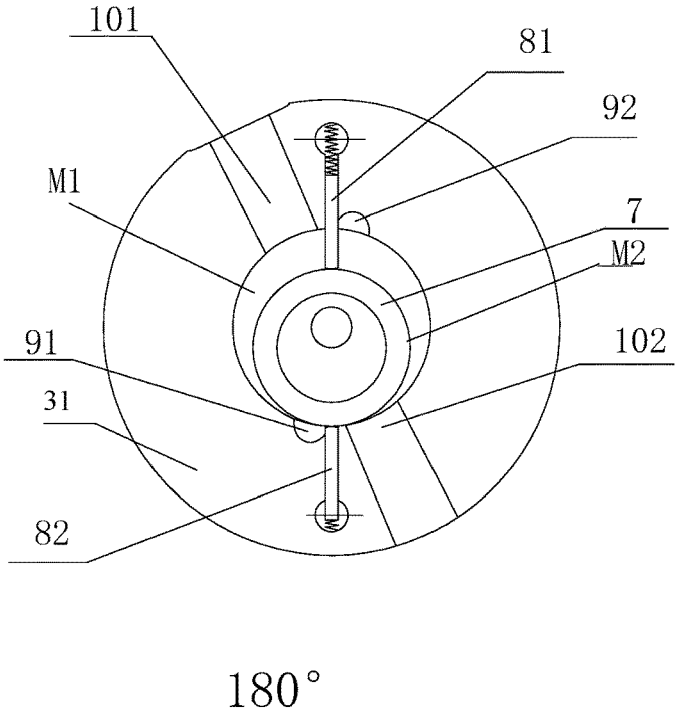
Figure 3D:
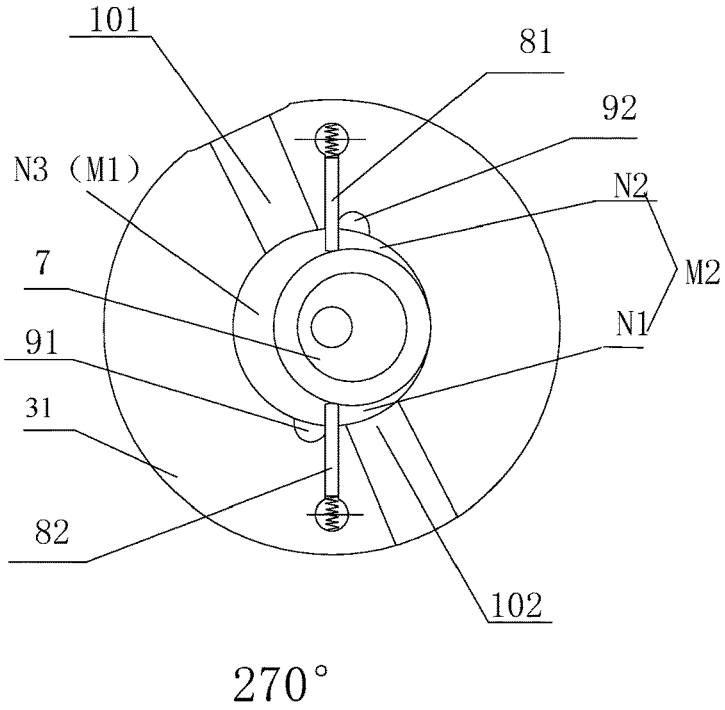

It can be seen from FIGS. 3*c* to 3*d* that, during a range of 180° to 360°, the intermediate chamber N3 is the first working chamber M1, and is in communication with the first air suction port 101, and the volume thereof increases firstly and then decreases. The volume reaches the maximum when at 270°. If there is no air suction valve in the first air suction port 101, when the crankshaft 60 rotates through 270°, the working fluid in the intermediate chamber N3 may flow backwards to the exterior of the first working chamber M1 via the first air suction port 101. Therefore, the maximum volume V1 of the first working chamber M1 occurs when at 270°.

Figure 5:
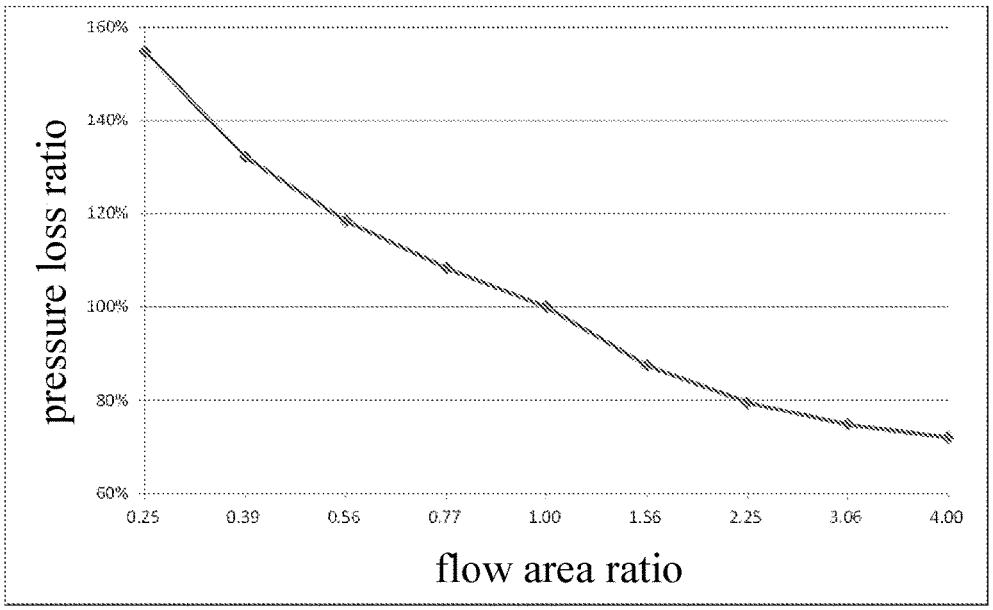
FIG. 5 is a pressure loss comparison chart according to an embodiment of the present disclosure.

Influence of a suction flowing area to a suction pressure loss is relatively large, and here a pipe pressure loss may be used to simplify the suction pressure loss, $$P_2 - P_1 = \rho * \lambda * \frac{l}{D_h} * \frac{u^2}{2} \tag{1}$$

wherein $(P_2-P_1)$ represents the pipe pressure loss;

$\rho$ represents a density of the working fluid;

$\lambda$ represents a friction coefficient between the working fluid and the pipe;

l represents a length of the pipe;

$D_h$ represents a hydraulic diameter of the pipe;

u represents a flowing speed of the working fluid;

Generally, the greater the pipe flow area is, the greater the hydraulic diameter of the pipe is; as shown in FIG. 5, at the same flow quantity, the smaller the flowing speed that flows through the pipe is, the smaller the pipe pressure loss is.

If a difference between the flowing speed of the working fluid flowing through the first air suction port 101 and the flowing speed of the working fluid flowing through the second air suction port 102 is relatively large, a difference of suction pressure losses of both is significant, an uneven distribution of the working fluid may be caused, and then fluid mass eventually entering the first working chamber M1 and the second working chamber M2 may change, resulting in insufficient suction and decrease of effective suction quantity.

In order to avoid the occurrence of the above-described problems, the opening area $S_1$ of the first air suction port 101 and the opening area $S_2$ of the second air suction port 102 must be designed reasonably. Accordingly, the first air suction port 101 and the second air suction port 102 according to embodiments of the present disclosure are configured to satisfy a following condition:

$$0.25 \le \frac{V_1}{S_1} * \frac{S_2}{V_2} \le 4$$

Therefore, the above problems can be effectively solved.

In summary, with the compression device according to embodiments of the present disclosure, by designing relationships between each of the first air suction port 101 and the second air suction port 102 and each of volumes of the first working chamber and the second working chamber, which improves the torque fluctuation of the rotary compressor, reduces the vibration of the rotary compressor, the noise and the costs increase effectively.

In an embodiment of the present disclosure, as shown in FIG. 2*b*, the first air discharge port 91 is located at an upstream of the second sliding vane slot 312 in a rotation direction of the crankshaft 6, and the second air discharge port 92 is located at an upstream of the first slide slot 311 in the rotation direction the crankshaft 6. It should be noted that, the upstream can be understood as an upstream in a flowing direction of the refrigerant within the chamber 40.

In addition, in order to ensure that the working fluid sucked from the air suction ports does not flow backwards to the exterior of the intermediate chamber N3 when the volume of the intermediate chamber N3 reaches the maximum, it is necessary to dispose an air suction valve in the air suction port. In a preferred embodiment of the present disclosure, a first suction valve 131 may be provided in the first air suction port 101. Further, a second air suction valve 132 may be provided in the second air suction port 102. As shown in FIGS. 2*a* and 2*b*, so, the increase of the displacement of the compressor can be achieved and the performance of the compressor can be improved.

Figure 6:
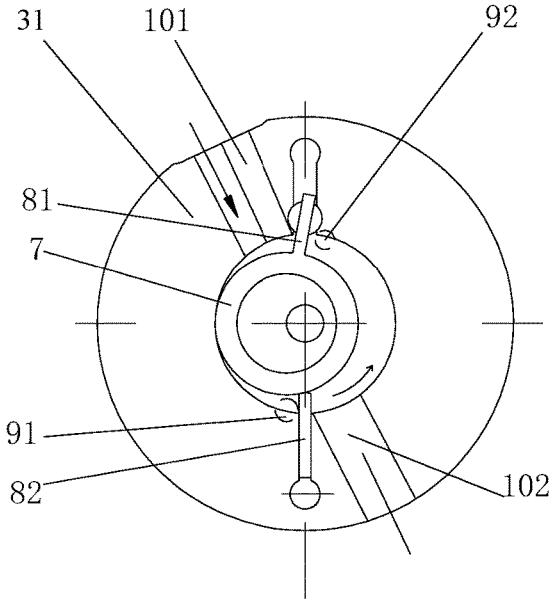
FIG. 6 is a schematic view showing a structure of a rotary compressor according to an embodiment of the present disclosure.

In an embodiment of the present disclosure, the first sliding vane 81 and the piston 71 are formed integrally, thus reducing effectively or even eliminating leakage losses and friction losses between the first sliding vane 81 and the piston 71. In the example of the present disclosure shown in FIG. 6, the first sliding vane 81 and the piston 71 are fixedly connected into one, forming one component. Specifically, the first sliding vane 81 and the piston 71 are machined and manufactured integrally, and at this moment the first sliding vane 81 is one portion of the piston 71, which has a simple machining and a low cost. Certainly, embodiments of the present disclosure are not limited thereto, and the first sliding vane 81 and the piston 7 may be achieved an integrated design by an articulating way or other ways.

According to some embodiments of the present disclosure, the first air suction port 101 and the second air suction port 102 are provided respectively in one of the air cylinder 31, the upper bearing 4 and the lower bearing 5. Preferably, the first air suction port 101, the second air suction port 102, the first air discharge port 91 and the second air discharge port 92 are all formed in the air cylinder 31. Similarly, according to some embodiments of the present disclosure, the first air discharge port 91 and the second air discharge port 92 are provided respectively in one of the air cylinder 31, the upper bearing 4 and the lower bearing 5.

Thereby, the compression device according to embodiments of the present disclosure has been improved based on a pump body of the conventional single-cylinder rotary compressor, i.e. a sliding vane is added while an air suction port and an air discharge port are added accordingly, so the two sliding vanes separate the space between the air cylinder and the piston into two independent working chambers, and when the crankshaft rotates one cycle each time, two times of air discharging can be achieved, thus making the torque fluctuation of the compressor improved, which is shown as "torque C" in FIG. 4.

In summary, the compression device according to embodiments of the present disclosure is applied to a single-cylinder compressor, in which one sliding vane is added only, thus omitting exponential increase of the air cylinder and the piston in the double-cylinder rotary compressor in the related art, and the cost of which is almost the same with that of the single-cylinder rotary compressor in the relater art, however, an effect similar with that of the torque curve of the double-cylinder rotary compressor is got, thus improving the torque fluctuation of the compressor. Further, with the compression device according to embodiments of the present disclosure, the air suction valves are added in each of the air suction port, and the actual displacement of the compressor can be improved greatly, thus improving the performance of the compressor.

Figure 7:
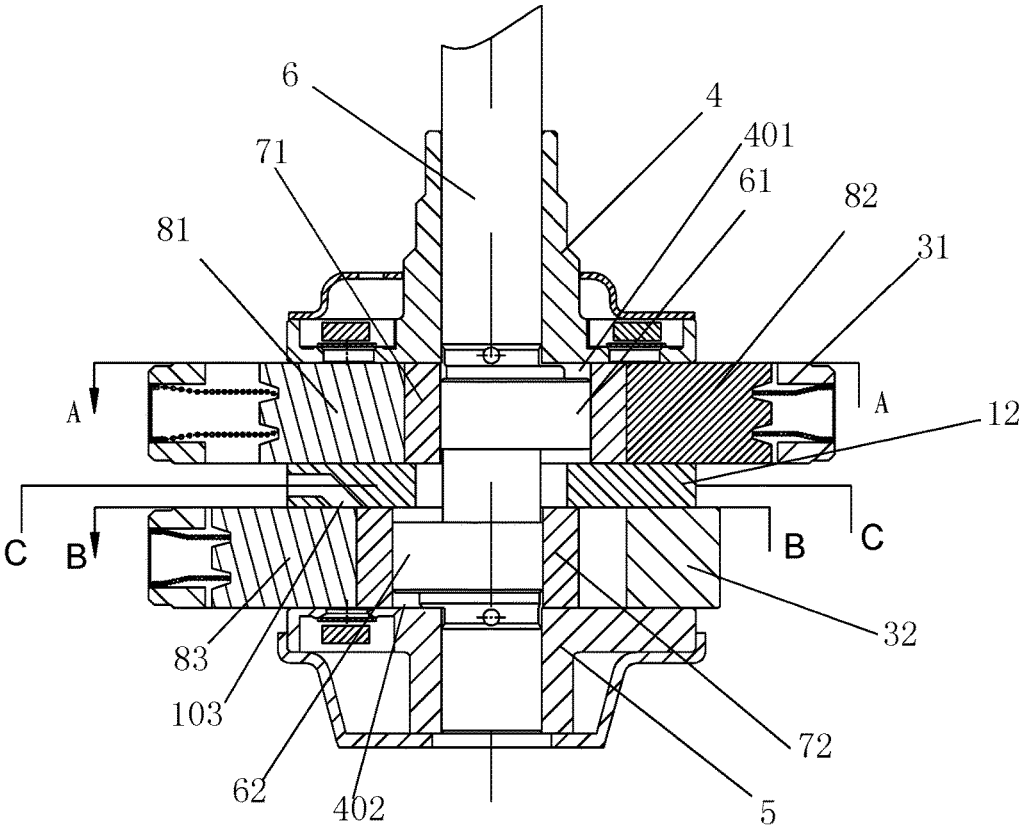
FIG. 7 is a schematic view showing a structure of a double-cylinder rotary compressor according to an embodiment of the present disclosure.
Figure 8:
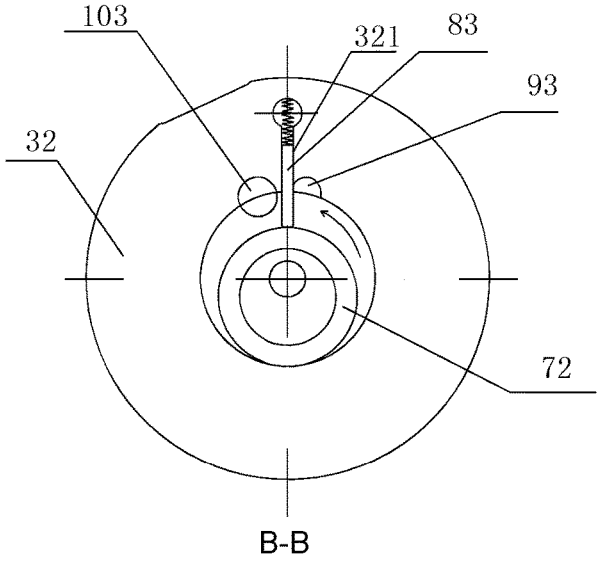
FIG. 8 is a schematic view showing a structure of a second compression portion of the rotary compressor shown in FIG. 7.

The above described embodiments are the compression device of the rotary compressor having a single-cylinder. However, the compression device according to embodiments of the present disclosure may be implemented in a double-cylinder way. Referring to FIGS. 7 and 8, on the basis of the above described compression device, a structure of a secondary air cylinder 32 and other components are added. It will be described in detail as follows.

According to another embodiment of the present disclosure, the compression device further includes a secondary air cylinder 32, a middle partition plate 12, a secondary piston 72, a third sliding vane 83, a third air suction port 103 and a third air discharge port 93. At this moment, the crankshaft 6 includes a first eccentric portion fitted over with the piston 71 and a second eccentric portion fitted over with the secondary piston 72, and an angle β between a protruding direction of the first eccentric portion and a protruding direction of the second eccentric portion in a rotation direction of the crankshaft satisfies $90° \leq \beta \leq 270°$. Preferably, the angle $\beta = 180°$.

Figure 9:
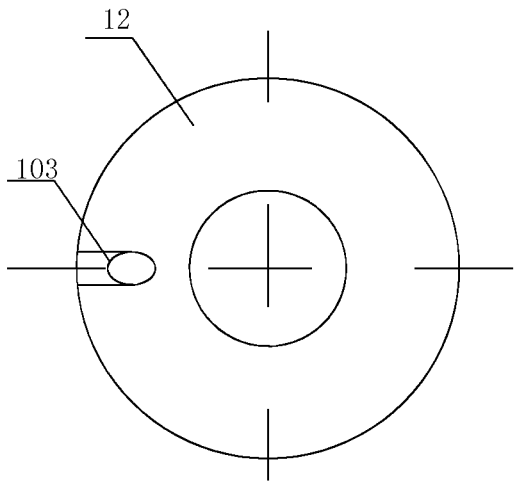
FIG. 9 is a schematic view showing a structure of a middle partition plate of the rotary compressor shown in FIG. 7.

As shown in FIGS. 7 to 9, the secondary air cylinder 32 is provided below the air cylinder 31 coaxially, and a third sliding vane slot 321 is formed in the secondary air cylinder 32. The middle partition plate 12 is provided between the air cylinder 31 and the secondary air cylinder 32 and separates the chamber 40 into an upper chamber 401 and a lower chamber 402, in which the piston 71 is provided within the upper chamber 401 and defines the working space together with an inner wall of the upper chamber 401. The secondary piston 72 is actuated by the eccentric crankshaft 6 and is provided within the lower chamber 402 eccentrically and can roll along an inner wall of the lower chamber 402, in which the secondary working space is defined between the secondary piston 72 and the inner wall of the lower chamber 402.

The third sliding vane 83 is provided within the third sliding vane slot 321 movably and a first end of the third sliding vane extends into an interior of the lower chamber 402 and abuts against the secondary piston 72. The third air suction port 103 is provided to be adjacent to the third sliding vane slot 321 and is in communication with the secondary working space, and the third air discharge port 93 is provided to be adjacent to the third sliding vane slot 321 and is in communication with the secondary working space. Working principle of each working chamber of the secondary air cylinder 32 is similar to that of the air cylinder 31, which will not be described herein.

In some alternative embodiments of the present disclosure, at least one of the first air suction port 101, the second air suction port 102 and the third air suction port 103 is provided in the middle partition plate 12, and at least one of the first air discharge port 91, the second air discharge port 92 and the third air discharge port 93 is provided in the middle partition plate 12.

According to some other alternative embodiments of the present disclosure, the third air suction port 103 is formed in one of the secondary air cylinder 32, the lower bearing 5 and the middle partition plate 12, and the third air discharge port 93 is formed in one of the secondary air cylinder 32, the lower bearing 5 and the middle partition plate 12. For example, as shown in FIGS. 7 to 9, the third air suction port 103 is formed in the middle partition plate 12 and the third air discharge port 93 is formed in the secondary air cylinder 32.

Similarly, in order to prevent working fluid sucked from the third air suction port 103 from flowing backwards and out of the intermediate chamber N3, there is a third suction valve 133 in the third air suction port 103. In addition, similar to the above described first sliding vane 81 and piston 71, the third sliding vane 83 and the secondary piston 72 may also be formed integrally.

Figure 10:
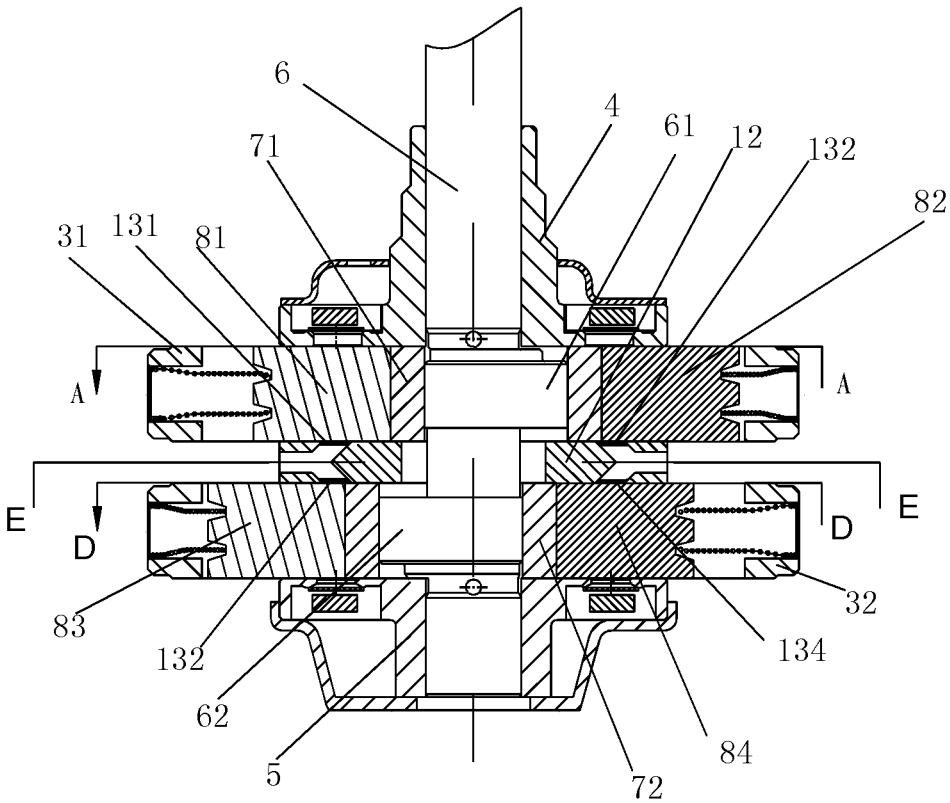
FIG. 10 is a schematic view showing a structure of a double-cylinder rotary compressor according to an embodiment of the present disclosure.
Figure 11:
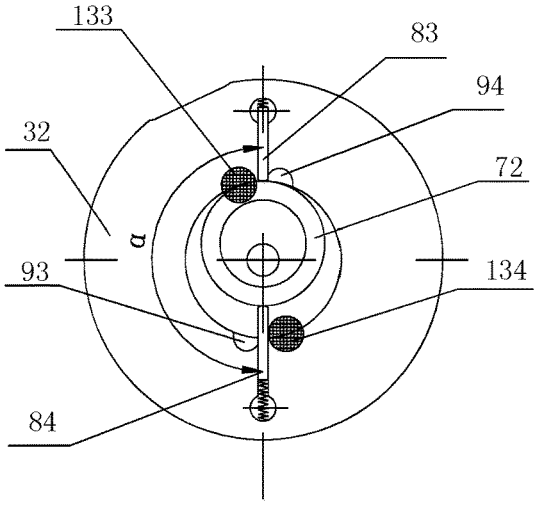
FIG. 11 is a schematic view showing a structure of a second compression portion of the rotary compressor shown in FIG. 10.

According to yet an embodiment of the present disclosure, on the basis of the above described embodiments, a relevant structure of a fourth sliding vane may be added. Specifically, as shown in FIGS. 10 to 11, the fourth sliding vane slot 322 may be formed in the secondary air cylinder 32, and the compression device further includes a fourth sliding vane 84, a fourth air suction port 104 and a fourth air discharge port 94. The fourth sliding vane 84 is provided within the fourth sliding vane slot 322 movably and a first end of the fourth sliding vane extends into the interior of the lower chamber 402 and abuts against the secondary piston 72. The fourth air suction port 104 is provided to be adjacent to the fourth sliding vane slot 322 and is in communication with the secondary working space, and the fourth air suction port 104 is provided to be adjacent to the fourth sliding vane slot 322 and is in communication with the secondary working space.

Figure 12:
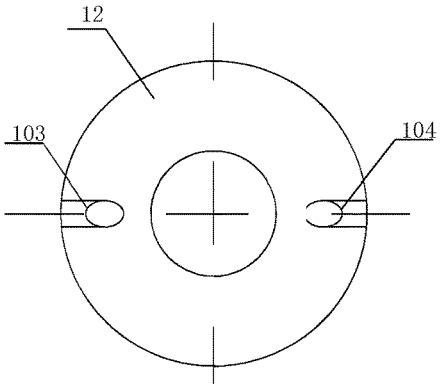
FIG. 12 is a schematic view showing a structure of a middle partition plate of the rotary compressor shown in FIG. 10.

In some alternative embodiments of the present disclosure, at least one of the first air suction port 101, the second air suction port 102, the third air suction port 103 and the fourth air suction port 104 is provided in the middle partition plate 12, and at least one of the first air discharge port 91, the second air discharge port 92, the third air discharge port 93 and the fourth air discharge port 94 is provided in the middle partition plate 12. For example, the first air suction port 101, the second air suction port 102, the third air suction port 103 and the fourth air suction port 104 are all provided in the middle partition plate 12, as shown in FIG. 12, the third air discharge port 93 and the fourth air discharge port 94 are provided in the secondary air cylinder 32.

In some other alternative embodiments of the present disclosure, the third air suction port 103 and the fourth air suction port 104 are provided respectively in one of the secondary air cylinder 32, the lower bearing 5 and the middle partition plate 12, and the third air discharge port 93 and the fourth air discharge port 94 are provided in one of the secondary air cylinder 32, the lower bearing 5 and the middle partition plate 12.

The working principle of each working chamber of the secondary air cylinder 32 added with the fourth sliding vane slot 84 is similar to that of the air cylinder 31, and which will not be described in detail herein. In order to ensure that the working fluid sucked from the air suction port does not flow backwards and out of the intermediate chamber N3 when the volume of the intermediate chamber N3 reaches the maximum, a fourth air suction valve 134 is provided within the fourth air suction port 104, as shown in FIGS. 10 and 11.

The compression device according to an embodiment of the present disclosure combines the advantages of the foregoing embodiments of the single-cylinder rotary compressor and the existing double-cylinder rotary compressor, thus further improving the torque fluctuation of the compressor greatly.

A rotary compressor according to embodiments of a second aspect of the present disclosure includes the compression device of the rotary compressor according to the foregoing embodiments of the present disclosure. The other constitution and operation of the rotary compressor according to embodiments of the present disclosure are well known for those skilled in the art, which will not be described in detail herein.

Figure 13:
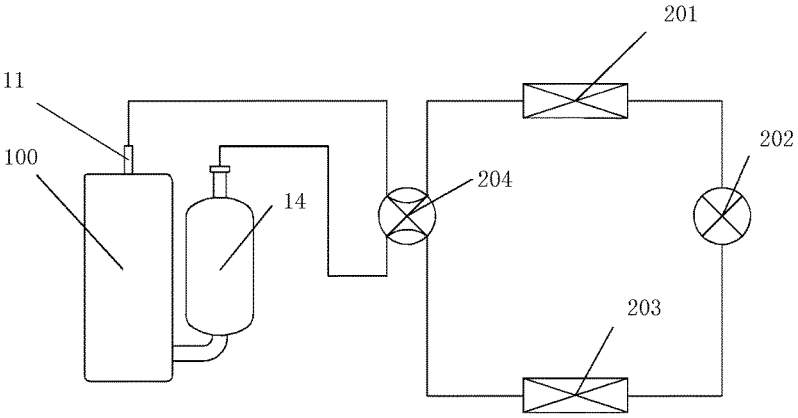
FIG. 13 is a schematic view showing an air conditioner according to another embodiment of the present disclosure.

As shown in FIG. 13, an air conditioner according to embodiments of a third aspect of the present disclosure includes the rotary compressor according to embodiments of the second aspect of the present disclosure. In the embodiment shown in FIG. 13, the air conditioner 200 is a heating and cooling air conditioner, further includes an outdoor heat exchanger 201, an indoor heat exchanger 203, a throttling device 202 and a four-way valve 204. The throttling device 202 is located between the outdoor heat exchanger 201 and the indoor heat exchanger 203. The four-way valve 204 includes four valve ports. A discharge pipe 11 of the rotary compressor 100 and an air intake pipe of a reservoir 14 are connected with two of the four valve ports respectively, other two of the four valve ports are connected with the outdoor heat exchanger 201 and the indoor heat exchanger 203 respectively.

The other constitution and operation of the air conditioner 200 according to embodiments of the present disclosure are well known for those skilled in the art, which will not be described in detail herein.

Reference throughout this specification to "an embodiment", "some embodiments", "one embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A compression device of a rotary compressor, comprising:

at least one of air cylinder being hollow and having an open top portion and an open bottom portion, wherein a first sliding vane slot and a second sliding vane slot are formed in the at least one of air cylinder;

an upper bearing and a lower bearing respectively provided on the open top portion and the open bottom portion of the at least one of air cylinder, so as to define a chamber together with the at least one of air cylinder;

a piston actuated by an eccentric crankshaft, provided within the chamber eccentrically and being rollable along an inner wall of the chamber, wherein a working space is defined between the piston and the inner wall of the chamber;

a first sliding vane and a second sliding vane, wherein the first sliding vane and the second sliding vane are provided respectively within the first sliding vane slot and the second sliding vane slot movably, first ends of the first sliding vane and the second sliding vane both extend into an interior of the chamber and abut against the piston, and the first sliding vane and the second sliding vane separate the working space into a first working chamber and a second working chamber;

a first air suction port and a second air suction port, wherein the first air suction port and the second air suction port are both in communication with the working space, and the first air suction port is provided to be adjacent to the first sliding vane slot and the second air suction port is provided to be adjacent to the second sliding vane slot;

a first air discharge port and a second air discharge port, wherein the first air discharge port and the second air discharge port are both in communication with the working space, and the first air discharge port is provided to be adjacent to the second sliding vane slot and the second air discharge port is provided to be adjacent to the first sliding vane slot;

wherein the first air suction port and the second air suction port are configured to satisfy a following condition:

$$0.25 << \frac{V_1}{S_1} \times \frac{S_2}{V_2} << 4$$

wherein $V_1$ represents a maximum volume of the first working chamber, $V_2$ represents a maximum volume of the second working chamber, $S_1$ represents an opening area of the first air suction port, and $S_2$ represents an opening area of the second air suction port.

2. The compression device according to claim 1, wherein in a rotation direction of the eccentric crankshaft, an angle θ between the first sliding vane and the second sliding vane satisfies 30°<θ<330°.

3. The compression device according to claim 2, wherein the angle θ=180°.

4. The compression device according to claim 1, wherein the first air discharge port is located at an upstream of the second sliding vane slot in a rotation direction of the eccentric crankshaft, and the second air discharge port is located at an upstream of the first sliding vane slot in the rotation direction the eccentric crankshaft.

5. The compression device according to claim 1, wherein a first air suction valve is provided within the first air suction port, and wherein a second suction valve is provided within the second air suction port.

6. The compression device according to claim 1, wherein the first sliding vane and the piston are molded integrally.

7. The compression device according to claim 1, wherein the first air suction port and the second air suction port are provided respectively in one of the at least one of air cylinder, the upper bearing and the lower bearing, and wherein the first air discharge port and the second air discharge port are provided respectively in one of the at least one of air cylinder, the upper bearing and the lower bearing.

8. The compression device according to claims 1, further comprising:

a secondary air cylinder provided below the at least one of air cylinder coaxially, wherein a third sliding vane slot is formed in the secondary air cylinder;

a middle partition plate provided between the at least one of air cylinder and the secondary air cylinder and separating the chamber into an upper chamber and a lower chamber, wherein the piston is provided within the upper chamber and defines the working space together with an inner wall of the upper chamber;

a secondary piston actuated by the eccentric crankshaft, provided within the lower chamber eccentrically and being rollable along an inner wall of the lower chamber, wherein a secondary working space is defined between the secondary piston and the inner wall of the lower chamber;

a third sliding vane, wherein the third sliding vane is provided within the third sliding vane slot movably and a first end of the third sliding vane extends into an interior of the lower chamber and abuts against the secondary piston;

a third air suction port, wherein the third air suction port is provided to be adjacent to the third sliding vane slot and is in communication with the secondary working space;

a third air discharge port, wherein the third air discharge port is provided to be adjacent to the third sliding vane slot and is in communication with the secondary working space.

9. The compression device according to claim 8, wherein at least one of the first air suction port, the second air suction port and the third air suction port is provided in the middle partition plate, and at least one of the first air discharge port, the second air discharge port and the third air discharge port is provided in the middle partition plate.

10. The compression device according to claim 8, wherein the third air suction port is formed in one of the secondary air cylinder, the lower bearing and the middle partition plate, and the third air discharge port is formed in one of the secondary air cylinder, the lower bearing and the middle partition plate, and the third air suction port is provided in the middle partition plate and the third air discharge port is provided in the secondary air cylinder.

11. The compression device according to claim 8, wherein a third suction valve is provided within the third air suction port.

12. The compression device according to claim 8, wherein the third sliding vane and the secondary piston are molded integrally.

13. The compression device according to claim 8, wherein a fourth sliding vane slot is formed in the secondary air cylinder, and the compression device further comprises:

a fourth sliding vane, wherein the fourth sliding vane is provided within the fourth sliding vane slot movably and a first end of the fourth sliding vane extends into the interior of the lower chamber and abuts against the secondary piston;

a fourth air suction port, wherein the fourth air suction port is provided to be adjacent to the fourth sliding vane slot and is in communication with the secondary working space;

a fourth air discharge port, wherein the fourth air discharge port is provided to be adjacent to the fourth sliding vane slot and is in communication with the secondary working space.

14. The compression device according to claim 13, wherein at least one of the first air suction port, the second air suction port, the third air suction port and the fourth air suction port is provided in the middle partition plate, and at least one of the first air discharge port, the second air discharge port, the third air discharge port and the fourth air discharge port is provided in the middle partition plate, and wherein the first air suction port, the second air suction port, the third air suction port and the fourth air suction port are all provided in the middle partition plate, and the third air discharge port and the fourth air discharge port are provided in the secondary air cylinder.

15. The compression device according to claim 13, wherein the third air suction port and the fourth air suction port are provided respectively in one of the secondary air cylinder, the lower bearing and the middle partition plate, and the third air discharge port and the fourth air discharge port are provided in one of the secondary air cylinder, the lower bearing and the middle partition plate.

16. The compression device according to claim 13, wherein a fourth suction valve is provided within the fourth air suction port.

17. The compression device according to claim 8, wherein the eccentric crankshaft comprises a first eccentric portion fitted over by the piston and a second eccentric portion fitted over by the secondary piston, and an included angle β between a protruding direction of the first eccentric portion and a protruding direction of the second eccentric portion in a rotation direction of the crankshaft satisfies $90° \leq \beta \leq 270°$.

18. The compression device according to claim 17, wherein the angle $\beta = 180°$.

19. A rotary compressor, comprising a compression device of a rotary compressor, the compression device of the rotary compressor comprising:

an air cylinder being hollow and having an open top portion and an open bottom portion, wherein a first sliding vane slot and a second sliding vane slot are formed in the air cylinder;

an upper bearing and a lower bearing respectively provided on the open top portion and the open bottom portion of the air cylinder, so as to define a chamber together with the air cylinder;

a piston actuated by an eccentric crankshaft, provided within the chamber eccentrically and being rollable along an inner wall of the chamber, wherein a working space is defined between the piston and the inner wall of the chamber;

a first sliding vane and a second sliding vane, wherein the first sliding vane and the second sliding vane are provided respectively within the first sliding vane slot and the second sliding vane slot movably, first ends of the first sliding vane and the second sliding vane both extend into an interior of the chamber and abut against the piston, and the first sliding vane and the second sliding vane separate the working space into a first working chamber and a second working chamber;

a first air suction port and a second air suction port, wherein the first air suction port and the second air suction port are both in communication with the working space, and the first air suction port is provided to be adjacent to the first sliding vane slot and the second air suction port is provided to be adjacent to the second sliding vane slot;

a first air discharge port and a second air discharge port, wherein the first air discharge port and the second air discharge port are both in communication with the working space, and the first air discharge port is provided to be adjacent to the second sliding vane slot and the second air discharge port is provided to be adjacent to the first sliding vane slot;

wherein the first air suction port and the second air suction port are configured to satisfy a following condition:

$$0.25 << \frac{V_1}{S_1} \times \frac{S_2}{V_2} << 4$$

wherein $V_1$ represents a maximum volume of the first working chamber, $V_2$ represents a maximum volume of the second working chamber, $S_1$ represents an opening area of the first air suction port, and $S_2$ represents an opening area of the second air suction port.

20. An air conditioner, comprising a rotary compressor, the rotary compressor comprising a compression device of the rotary compressor, and the compression device of the rotary compressor comprising:

an air cylinder being hollow and having an open top portion and an open bottom portion, wherein a first sliding vane slot and a second sliding vane slot are formed in the air cylinder;

an upper bearing and a lower bearing respectively provided on the open top portion and the open bottom portion of the air cylinder, so as to define a chamber together with the air cylinder;

a piston actuated by an eccentric crankshaft, provided within the chamber eccentrically and being rollable along an inner wall of the chamber, wherein a working space is defined between the piston and the inner wall of the chamber;

a first sliding vane and a second sliding vane, wherein the first sliding vane and the second sliding vane are provided respectively within the first sliding vane slot and the second sliding vane slot movably, first ends of the first sliding vane and the second sliding vane both extend into an interior of the chamber and abut against the piston, and the first sliding vane and the second sliding vane separate the working space into a first working chamber and a second working chamber;

a first air suction port and a second air suction port, wherein the first air suction port and the second air suction port are both in communication with the working space, and the first air suction port is provided to be adjacent to the first sliding vane slot and the second air suction port is provided to be adjacent to the second sliding vane slot;

a first air discharge port and a second air discharge port, wherein the first air discharge port and the second air discharge port are both in communication with the working space, and the first air discharge port is provided to be adjacent to the second sliding vane slot and the second air discharge port is provided to be adjacent to the first sliding vane slot;

wherein the first air suction port and the second air suction port are configured to satisfy a following condition:

$$0.25 << \frac{V_1}{S_1} \times \frac{S_2}{V_2} << 4$$

wherein $V_1$ represents a maximum volume of the first working chamber, $V_2$ represents a maximum volume of the second working chamber, $S_1$ represents an opening area of the first air suction port, and $S_2$ represents an opening area of the second air suction port.

* * * * *